US012070143B2

(12) United States Patent
McManaman

(10) Patent No.: US 12,070,143 B2
(45) Date of Patent: Aug. 27, 2024

(54) APPARATUS FOR DRINKING

(71) Applicant: Timothy John McManaman, Normal, IL (US)

(72) Inventor: Timothy John McManaman, Normal, IL (US)

( * ) Notice: Subject to any disclaimer, the term of this patent is extended or adjusted under 35 U.S.C. 154(b) by 142 days.

(21) Appl. No.: 17/681,229

(22) Filed: Feb. 25, 2022

(65) Prior Publication Data

US 2023/0270271 A1 Aug. 31, 2023

(51) Int. Cl.
*A47G 21/18* (2006.01)

(52) U.S. Cl.
CPC ..... *A47G 21/185* (2013.01); *A47G 21/18* (2013.01)

(58) Field of Classification Search
CPC ..... A47G 21/185; A47G 21/18; A47G 21/186
See application file for complete search history.

(56) References Cited

U.S. PATENT DOCUMENTS

D321,106 S * 10/1991 Whitright ..... D7/300.2
D389,365 S * 1/1998 Lipson ..... D7/300.2
D467,460 S * 12/2002 Swanson ..... D7/300.2
D487,375 S * 3/2004 Bengtsson ..... D7/300.2
7,040,547 B1 * 5/2006 Nelson ..... A47G 21/185 239/33
D815,479 S * 4/2018 Scardino ..... D7/300.2
2004/0195347 A1 * 10/2004 Kim ..... A47G 21/185 239/33
2014/0339325 A1 * 11/2014 Williams ..... A47G 21/18 239/33
2018/0368598 A1 * 12/2018 Goldstein ..... A47G 21/185

* cited by examiner

*Primary Examiner* — Jason J Boeckmann

(57) ABSTRACT

An apparatus for drinking featuring a tubular body with an open bottom end and a closed top end, the tubular body formed to provide a lip stabilizer section at or near horizontal and generally parallel to the lips of a user when in use. The apparatus for drinking further comprising a port in the wall of the tubular body located in the lip stabilizer section. When in use, the apparatus for drinking comes in contact with the lips of a user and the user induces suction to the tubular body through the port located in the lip stabilizer section. The suction induces the flow of liquids through the tubular body and through the port and into the mouth of a user. The lip stabilizer section provides a stabilizing effect to the lips of the user minimizing creases or folds in the lips of the user when in use.

8 Claims, 5 Drawing Sheets

APPARATUS FOR DRINKING

CROSS-REFERENCE TO RELATED APPLICATIONS

Not applicable.

BACKGROUND OF THE INVENTION

Field of the Invention

The present invention relates generally to apparatuses for drinking, and more particularly to an improved apparatus for drinking.

An apparatus for drinking, typically referred to as a straw, normally comprises a tube with two open ends. The normal use of a straw is for drinking beverages and is accomplished by a user placing one end of the straw into a beverage container and the other end of the straw into the mouth of a user. The user induces suction into one open end of the straw and in doing so, creates a puckering of the lips wherein the lips gather or contract around the open end of the straw and creates temporary creases or small folds in the lips of a user. When a user uses a straw regularly and over an extended time period, the puckering of the lips and resulting creases or small folds in the lips of a user can begin to become permanent and undesirable over time. This invention relates to an improved apparatus for drinking, and more specifically, to an improved apparatus for drinking including a lip stabilizer section configured to minimize the puckering of the lips of a user, and to further minimize creases and small folds in the lips of a user when in use.

Description of Related Art

There have been a number of improvements to apparatuses for drinking and drinking straws since first invented. A bendable insulated drinking straw is described in U.S. Pat. No. 6,460,777B2. A straw with a one-way valve is described in U.S. Pat. No. 8,931,634B2. A spill proof straw is described in U.S. Pat. No. 6,915,961B2. A One-Piece Cleanable and Reusable Drinking Straw is described in U.S. Patent 20210219759A1. Although there have been improvements to apparatuses for drinking, none provide the improvements as described in the present invention.

BRIEF SUMMARY OF THE INVENTION

The present invention provides an improved apparatus for drinking and the advantages will be apparent to persons skilled in the art.

Accordingly, it is an object of the present invention to provide an apparatus for drinking for drinking liquids out of a container comprising a tubular body having a closed top end and an open bottom end, the tubular body having a lower portion, a middle portion, and an upper portion. The middle portion having one or more bends. The open bottom end provides an inlet for the flow of liquids when in use. The upper portion provides a port located in the wall of the tubular body wherein the port allows for the flow of liquids into the mouth of the user when in use.

Another object of the present invention is to provide a port in the lip stabilizer section in the upper portion of the tubular body. The lip stabilizer section formed at or near horizontal to the lips of a user when in use. The port, located in the wall of the tubular body, is located generally in the middle of the lip stabilizer section, so that when the apparatus for drinking engages the lips of a user, and a suction force is induced, liquids will flow from a container through the tubular body and out through the port of the tubular body and into the mouth of a user.

Another object of the present invention is to provide a lip stabilizing effect to the lips of user when the lip stabilizer section comes in contact with the lips of a user.

Another object of the present invention is to minimize the puckering of the lips of a user when engaging and using the apparatus for drinking. Minimizing puckering of the lips over extended time periods may minimize or prevent creases or small folds in the lips of a user.

Another object of the present invention is to provide a middle portion that is attachable to and detachable from a conventional drinking straw.

A further object of the present invention is to provide a lip stabilizer section that is attachable to and detachable from a conventional drinking straw.

Yet another object of the present invention is to provide an apparatus for drinking which enables the flow of liquids from a container to the mouth of a user when the lip stabilizer section of the apparatus for drinking comes in contact with the lips of a user, while not penetrating the lips of a user.

These and other objects of this invention shall become more apparent from the ensuing descriptions of the invention.

BRIEF DESCRIPTION OF THE SEVERAL VIEWS OF THE DRAWINGS

The novel features of the apparatus for drinking are set forth in the claims. The invention itself, as well as its features will be best understood by the reference to the detailed drawings and accompanying description. It is appreciated that these drawings show preferred embodiments of the invention, however, should not be considered limiting, wherein:

DETAILED DESCRIPTION OF THE INVENTION

Figure 1:
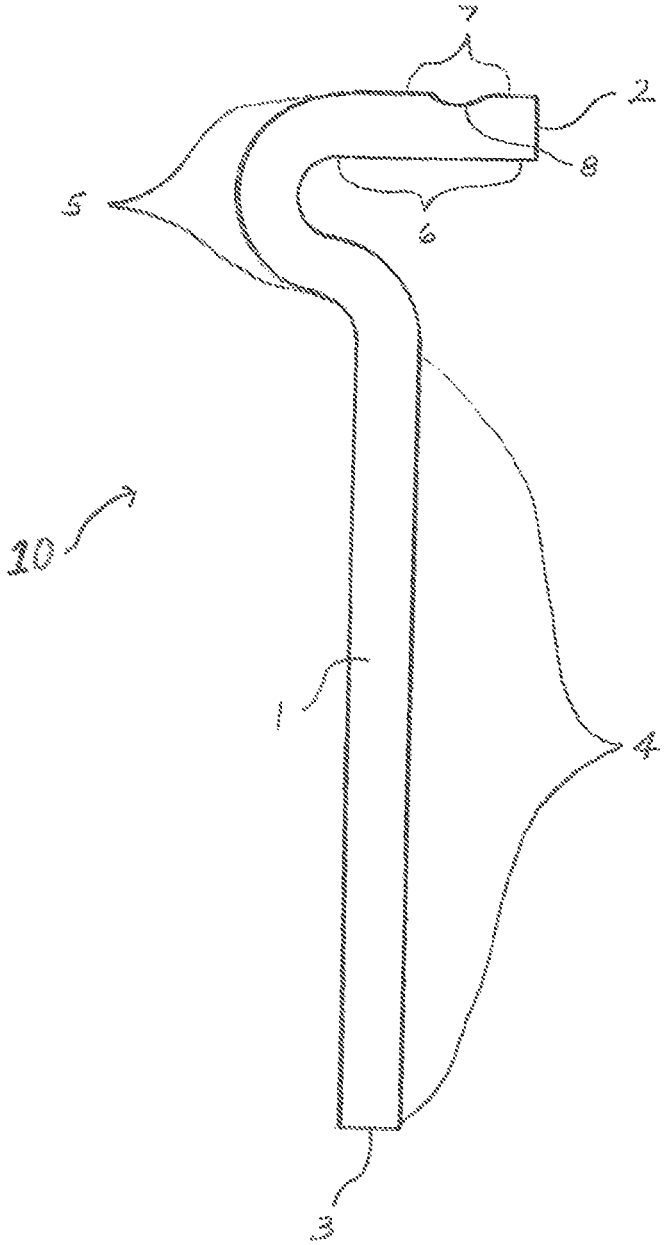
FIG. 1 shows a front view of the apparatus for drinking according to one embodiment of this invention.

Referring to FIG. 1, an apparatus for drinking designated by the numeral 10, is described. This embodiment of the invention comprises a tubular body 1, having a closed top end 2, an open bottom end 3, a lower portion 4, a middle portion 5, an upper portion 6, the lower portion 4 extending from the open bottom end 3 to the bottom of middle portion 5, the middle portion 5 extending from the top of the lower portion 4 to the bottom of the upper portion 6, the upper portion 6 extending from the top of the middle portion 5 to the closed top end 2, a lip stabilizer section 7, the lip stabilizer section 7 located in the upper portion 6 of the tubular body 1, and a port 8 formed in the wall of the tubular body 1 and located in the lip stabilizer section 7. The port 8 enabling a user to induce suction to the tubular body 1 and induce the flow of liquids through the tubular body 1 and into the mouth of a user when the lip stabilizer section 7 is engaged by the lips of a user. It is appreciated that the tubular body 1 comprises a material from the group of either: plastic, silicone, rubber, metal or glass and it is further appreciated that the tubular body 1 comprises a plurality of cross sectional shapes such as round, oval, or other shapes with a plurality of sides. The invention further comprises a middle portion 5 wherein the middle portion 5 comprises a plurality of bends, the first bend extending from the bottom of the middle portion 5 in one direction, and the second bend extending in an opposite direction bending to a degree greater than the first bend. This embodiment of the invention shows the lower portion 4 generally straight, however it is appreciated that the lower portion 4 could be formed with a plurality of bends. A novel feature of the invention is the lip stabilizer section 7 is configured at or near horizontal such that the lip stabilizer section 7 is at or near parallel to the lips of a user when in use.

Figure 2:
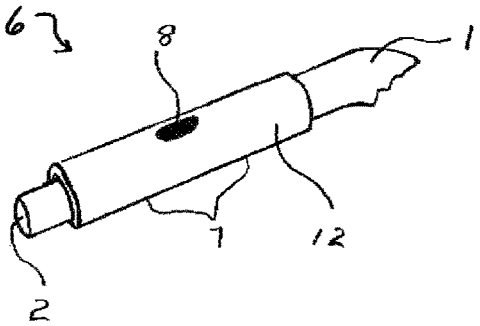
FIG. 2 shows a three dimensional sectional view of the upper portion of the apparatus for drinking showing the lip stabilizer section and port located in the upper portion with a raised pad according to one embodiment of this invention.

Referring to FIG. 2, one embodiment of this invention shows the upper portion 6 of the tubular body 1 showing the lip stabilizer section 7 having a raised pad 12 for engaging the lips of a user. Typically raised pad 12 would be formed of a material to provide a cushioning effect to the lips of a user when the upper portion 6 of the tubular body 1 comprises a metal material so that to prevent any inadvertent metal contact with the teeth of a user when in use. It is further shown that upper portion 6 comprises a closed end 2 and a port 8 formed in the tubular body 1 located in the lip stabilizer section 7. It is appreciated that raised pad 12 could be formed of a variety of shapes and materials and it is further appreciated that the raised pad 12 is formed to not restrict the flow of liquids through the port 8. It is further appreciated that port 8, shown as an oval, could be formed of a plurality of shapes.

Figure 3:
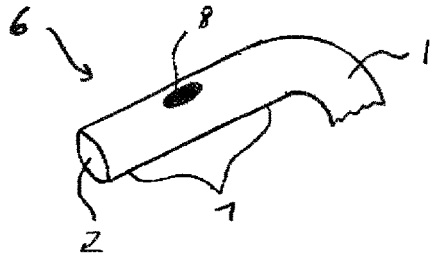
FIG. 3 shows a three dimensional sectional view of the upper portion of the apparatus for drinking showing another variation of the lip stabilizer section and port located in the upper portion.

Referring to FIG. 3, one embodiment of this invention shows the upper portion 6 of the tubular body 1 comprising the port 8 formed in the wall of the tubular body 1 generally located in the center of the lip stabilizer section 7.

Figure 4:
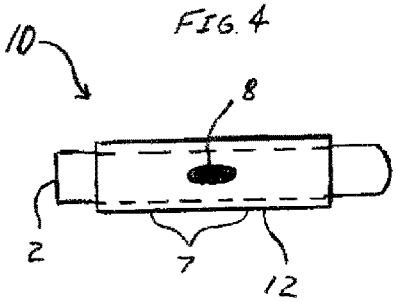
FIG. 4 shows a top view of the apparatus for drinking showing the lip stabilizer section, the port and the raised pad according to one embodiment of this invention.

Referring to FIG. 4, the apparatus for drinking 10 is shown in a top view with the port 8 generally located in the center of the raised pad 12. It is appreciated again that port 8, shown as an oval, could be formed of a plurality of shapes.

Figure 5:
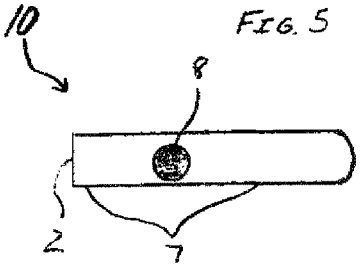
FIG. 5 shows a top view of the apparatus for drinking showing another variation of the port shape and port location in the lip stabilizer section.

Referring to FIG. 5, the apparatus for drinking 10 is shown in a top view with the port 8 of a circular shape and generally located at one side of lip stabilizer section 7.

Figure 6:
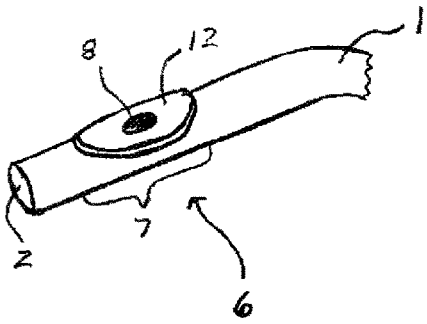
FIG. 6 shows a three dimensional sectional view the upper portion of the apparatus for drinking showing another variation of the raised pad.

Referring to FIG. 6, another embodiment is shown where the upper portion 6 of the tubular body 1 is illustrated with the lip stabilizer section 7 having a raised pad 12 of yet another shape.

Figure 7:
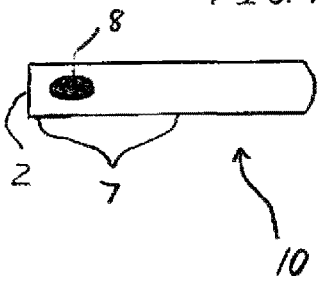
FIG. 7 is a top view of the apparatus for drinking showing another variation of the port location.

Referring to FIG. 7 another embodiment of the apparatus for drinking 10 is shown in a top view with the port 8 formed as an oval shape located in yet another position in the lip stabilizer section 7 and nearer the closed end 2. It is appreciated that port 8 could be located in a plurality of positions in the lip stabilizer section 7.

Figure 8:
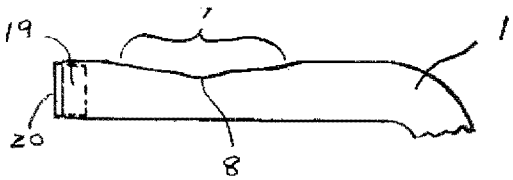
FIG. 8 is a front sectional view of the upper portion of the apparatus for drinking showing a variation in the shape of the lip stabilizer section, according to one embodiment of this invention.

Referring to FIG. 8 another embodiment of this invention shows the upper portion 6 of the tubular body 1 with the lip stabilizer section 7 configured as another shape. This illustration shows the lip stabilizer section 7 of a shape substantially complimentary to the lips of a user. Further shown is the port 8 generally located in the center of the lip stabilizer section 7. This embodiment further shows the upper portion 6 with the open end 19 and the open end 19 being closed with a removable plug 20. The removable plug 20 providing an opening and closing means to access the upper portion 6 of the tubular body 1 for cleaning purposes. It is appreciated that the removable plug 20 comprises a plurality of materials.

Figure 9:
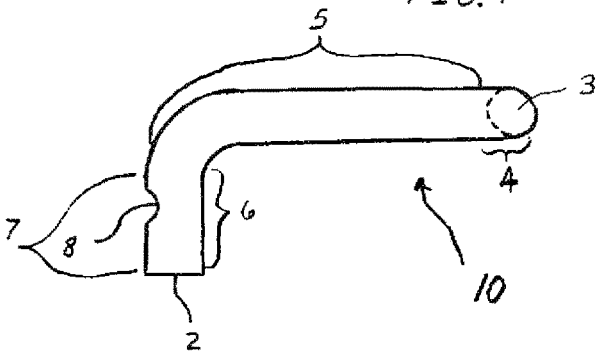
FIG. 9 is a top view of the apparatus for drinking showing a variation in the bends in the middle portion according to one embodiment of this invention.

Referring to FIG. 9 another embodiment of the apparatus for drinking 10 is shown with the upper portion 6 illustrating a bend at a right angle and on a generally similar plane to the middle portion 5 and the middle portion 5 illustrating a bend at a right angle and on a generally similar plane to the lower portion 4. This view illustrates a plurality of bends present in this embodiment of the invention. It is appreciated that there are a plurality of bends to be considered for the lower portion 4, the middle portion 5 and the upper portion 6 by one skilled in the art to provide the lip stabilizer 7 at or near horizontal such that the lip stabilizer 7 is at or near parallel to the lips of a user when in use.

Figure 10:
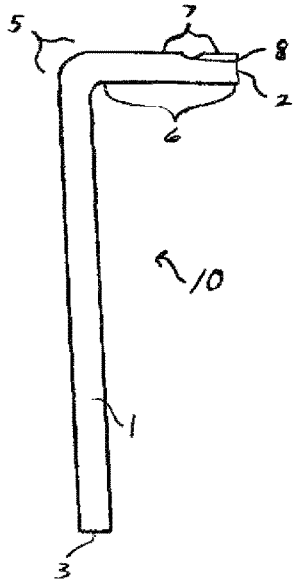
FIGS. 10 through 14 show front views of several variations of the apparatus for drinking showing variations in the bends in the middle and upper portions and variations in the location of the port in the lip stabilizer section.

Referring to FIG. 10 an embodiment of the apparatus for drinking 10 is shown illustrating a variation in the bend in the middle portion 5 of the tubular body 1 shown at or near a right angle with a radius in the bend in the middle portion 5. This embodiment further shows the lip stabilizer section 7 located in the upper portion 6 at or near horizontal.

Figure 11:
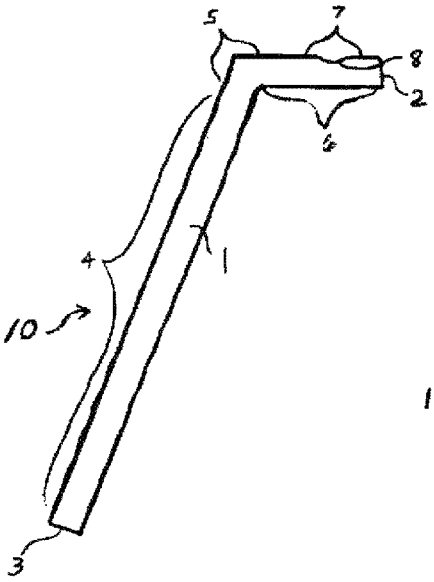

Referring to FIG. 11 an embodiment of the apparatus for drinking 10 is shown illustrating a variation in the bend in the middle portion 5 of the tubular body 1. The bend is shown at or near a 45 degree angle. This embodiment further shows the lip stabilizer section 7 located in the upper portion 6 at or near horizontal with the lower portion 4 at an angle.

Figure 12:
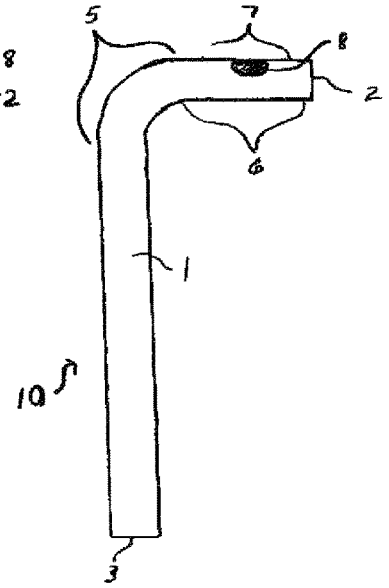

Referring to FIG. 12 an embodiment of the apparatus for drinking 10 is shown illustrating another variation in the bend in the middle portion 5 of the tubular body 1 shown at or near a right angle. The radius in the bend is show as a larger radius as compared to the radius shown in FIG. 11. This embodiment further shows a variation in the location of the port 8 located in the lip stabilizer section 7.

Figure 13:
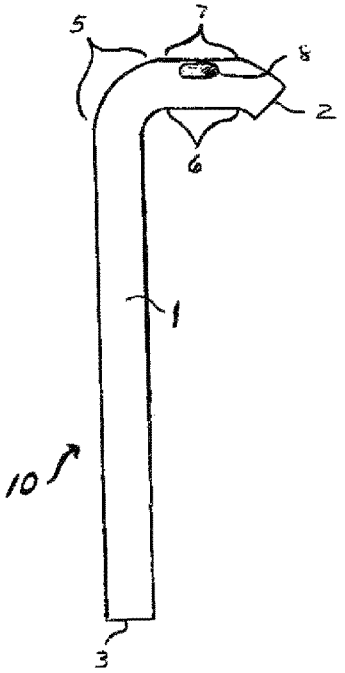

Referring to FIG. 13 an embodiment of the apparatus for drinking 10 is shown illustrating variations in the bends in both the middle portion 5 and the upper portion 6 of the tubular body 1. This embodiment further illustrates the lip stabilizer section 7 at or near horizontal.

Figure 14:
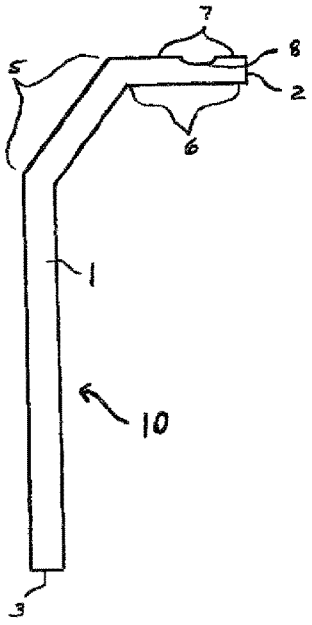

Referring to FIG. 14 an embodiment of the apparatus for drinking 10 is shown illustrating yet another variation in the bends in the middle portion 5. This embodiment shows two bends at or near 45 degrees in the middle portion 1 and the upper portion 6 resulting in a combined at or near 90 degree bend such that the lip stabilizer section 7 is at or near horizontal.

Figure 15A:
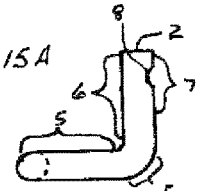
FIGS. 15A and 15B show a side and top view of another embodiment of this invention showing another variation in the bends in the middle and upper portions.
Figure 15B:
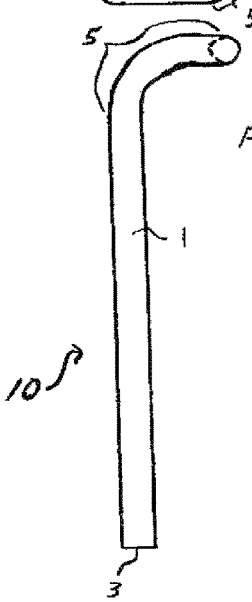

Referring to FIGS. 15A and 15B an embodiment of the apparatus for drinking 10 is shown in a top view 15A and a front view 15B to further illustrate a variation in the bends in the middle portion 5. Referring to FIG. 15A a first at or near 90 degree bend in the middle portion 5 is shown and referring to FIG. 15B a second at or near 90 degree bend in the middle portion 5 is shown. The bends in the middle portion 5 combined are configured to provide the lip stabilizer section 7 at or near horizontal. It is appreciated that a plurality of bends can be configured to provide the lip stabilizer section 7 at or near horizontal.

Figure 16:
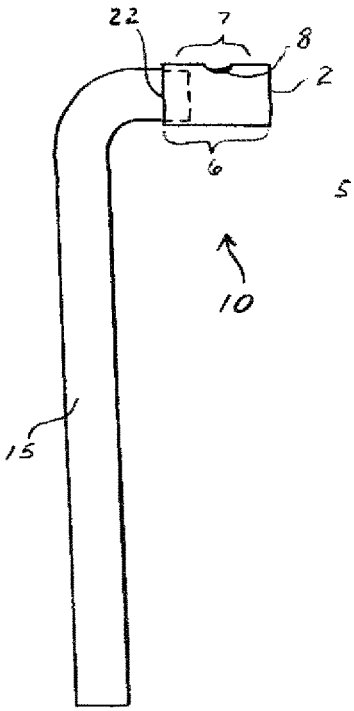
FIG. 16 is a front view showing one embodiment of this invention showing the upper portion and the lip stabilizer section attached to a conventional drinking straw.

Referring to FIG. 16 an embodiment of the apparatus for drinking 10 is shown with a variation where the upper portion 6 is attached to a conventional drinking straw 15. The upper portion 6 is configured with a closed end 2 and an open connector end 22 providing a means for the upper portion 6 to be attachable to and detachable from a conventional drinking straw 15. This embodiment shows the upper portion 6 in a straight configuration attached to a conventional drinking straw 15. This embodiment further shows the lip stabilizer section 7 at or near horizontal and the port 8 located in the lip stabilizer section 7.

Figure 17:
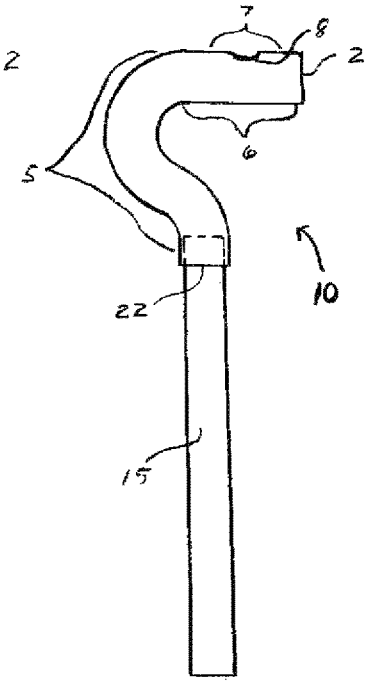
FIG. 17 is a front view showing another embodiment of this invention showing the middle portion, the upper portion and the lip stabilizer section attached to a conventional drinking straw.

Referring to FIG. 17 an embodiment of the apparatus for drinking 10 is shown with a variation where the middle portion 5 is configured with an open connector end 22 providing a means for the middle portion 5 is attached to a conventional drinking straw 15. The middle portion 5 is configured to be attachable to and detachable from a conventional drinking straw 15. This embodiment further shows the upper portion 5 comprises a plurality of bends, the first bend extending from the bottom of the middle portion 5 in one direction, and the second bend extending in an opposite direction bending to a degree greater than the first bend, and upper portion 5 attaching to a conventional drinking straw 15 through the open connector end 22. This embodiment further shows the lip stabilizer section 7 at or near horizontal and the port 8 located in the lip stabilizer section 7.

Figure 18:
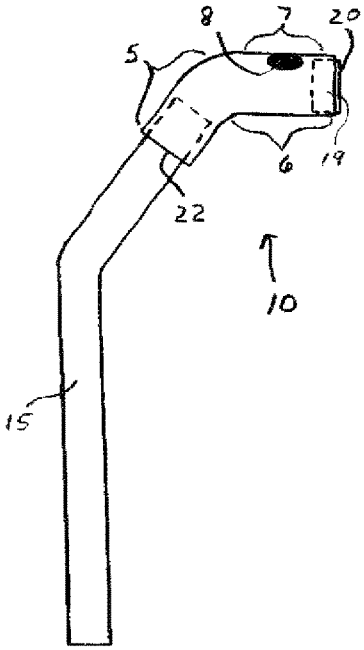
FIG. 18 is a front view showing yet another embodiment of this invention showing the middle portion, the upper portion and the lip stabilizer section attached to a conventional drinking straw.

Referring to FIG. 18 an embodiment of the apparatus for drinking 10 is shown with a variation where the upper portion 6 is configured with an open end 19 and the open end 19 being closed with a removable plug 20. The removable plug 20 providing an opening and closing means to access the upper portion 6 for cleaning purposes. This embodiment further shows the middle portion 5 attached to a conventional drinking straw 15. The middle portion 5 is configured with a an open connector end 22 providing a means for the middle portion 5 to be attachable to and detachable from a conventional drinking straw 15. This embodiment further shows the middle portion 5 configured with one bend and the middle portion 5 connecting to a conventional drinking straw 15 through the open connector end 22. This embodiment further shows the lip stabilizer section 7 at or near horizontal and the port 8 located in the lip stabilizer section 7.

Figure 19:
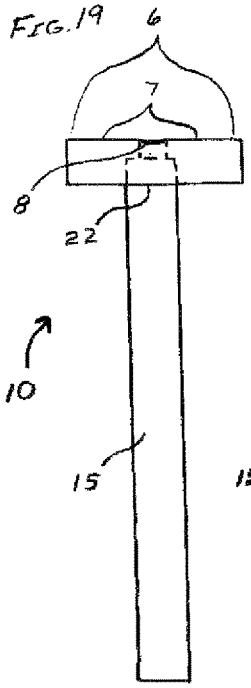
FIG. 19 is front view showing another embodiment of this invention showing the upper portion and the lip stabilizer section attached to a conventional drinking straw.

Referring to FIG. 19 an embodiment of the apparatus for drinking 10 is shown with a variation where the upper portion 6 is configured with an open connector end 22 where the upper portion 6 connects perpendicularly to a conventional drinking straw 15. The lip stabilizer section 7 located within the upper portion 6 is shown at or near horizontal. The port 8 is located generally in the center of the lip stabilizer section 7.

Figure 20:
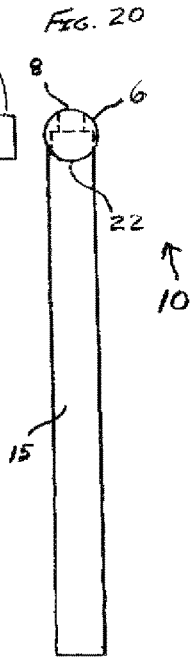
FIG. 20 is side view showing the upper portion and the lip stabilizer section attached to a conventional drinking straw.

Referring to FIG. 20 an embodiment of the apparatus for drinking 10 is shown in a side view further illustrating the upper portion 6 formed of a cylindrical shape. The upper portion 6 is configured with the open connector end 22 where the upper portion 6 connects perpendicularly to a conventional drinking straw 15.

Figure 21:
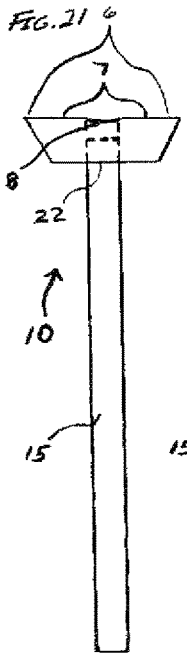
FIG. 21 is a front view showing yet another embodiment of this invention showing the upper portion and the lip stabilizer section attached to a conventional drinking straw.

Referring to FIG. 21 an embodiment of the apparatus for drinking 10 is shown with a variation where the upper portion 6 is configured with the open connector end 22 where the upper portion 6 connects perpendicularly to a conventional drinking straw 15. The lip stabilizer section 7 located within the upper portion 6 is shown at or near horizontal. The port 8 is located generally in the center of the lip stabilizer section 7.

Figure 22:
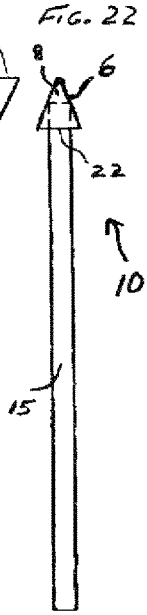
FIG. 22 is a side view showing the upper portion and the lip stabilizer section attached to a conventional drinking straw.

Referring to FIG. 22 an embodiment of the apparatus for drinking 10 is shown in a side view further illustrating another variation where the upper portion 6 is formed in a triangular shape. The upper portion 6 is configured with the open connector end 22 where the upper portion 6 connects perpendicularly to a conventional drinking straw 15.

Figure 23:
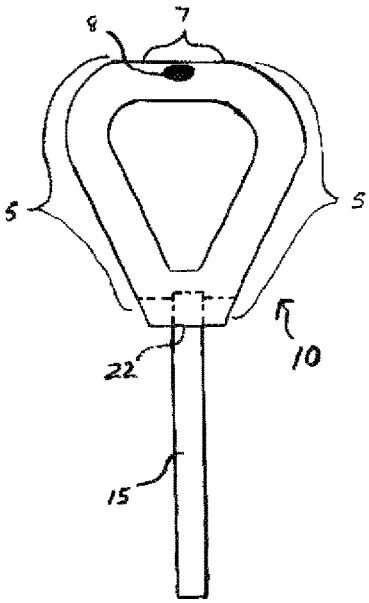
FIG. 23 is a front view of another variation of this invention showing the middle portion and the lip stabilizer section configured to attach to a conventional drinking straw.

Referring to FIG. 23 an embodiment of the apparatus for drinking 10 is shown with another variation where the middle portion 5 is formed on two sides and connected to a conventional drinking straw 15 with the open connector end 22. The lip stabilizer section 7 is shown at or near horizontal. The port 8 is located generally in the center of the lip stabilizer section 7.

Figure 24:
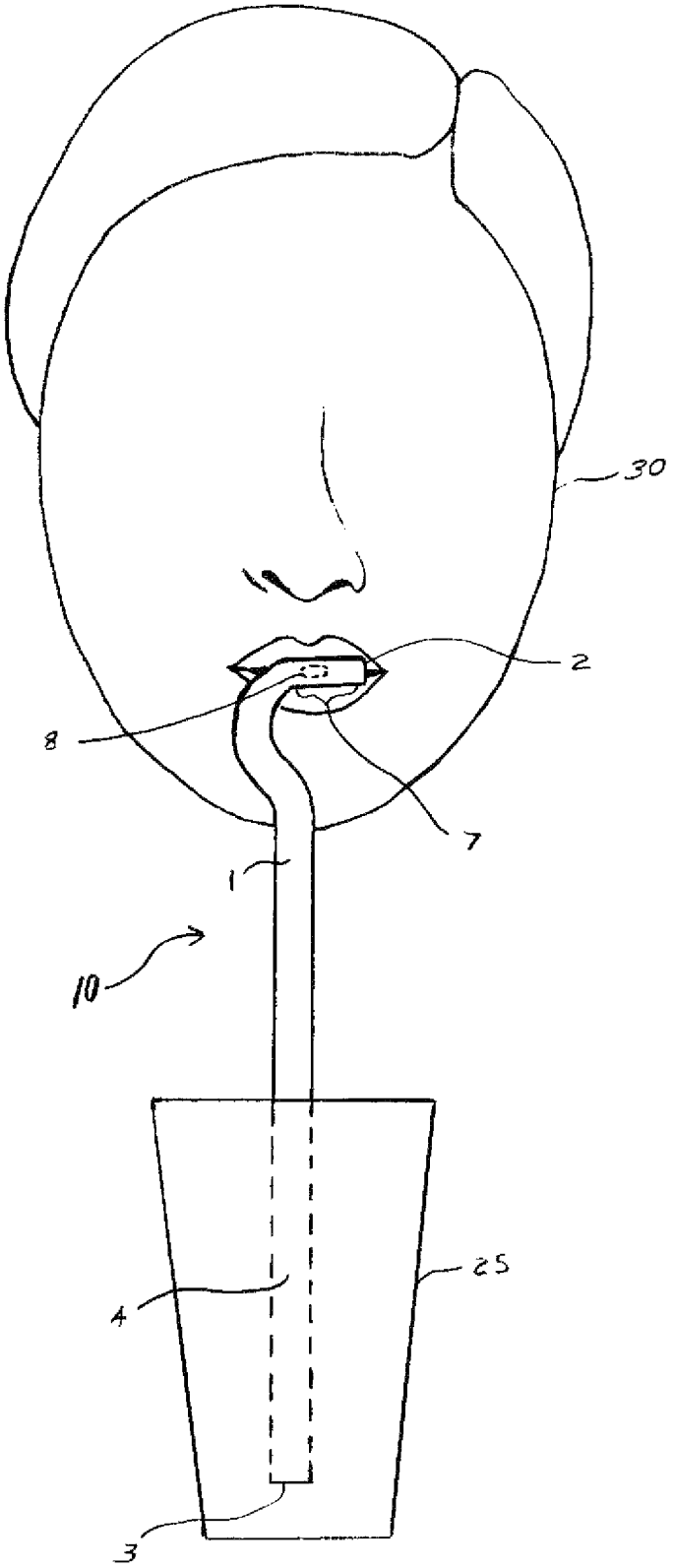
FIG. 24 is a front view showing one embodiment of the apparatus for drinking inserted into a container containing liquids, the lip stabilizer section formed horizontal and parallel to the lips of a user, the lip stabilizer section positioned for inducing suction and enabling the flow of liquids through the tubular body and through the port and into the mouth of the user, providing a stabilizing effect to the lips of a user while not penetrating the lips of the user.

Referring to FIG. 24 an embodiment of the apparatus for drinking 10 is shown where the lower portion 4 of the tubular body 1 is immersed into a container 25 containing liquids. The lip stabilizer section 7 is in contact with the lips of a user 30 at or near horizontal and at or near parallel to the lips of a user 30. A user 30 induces suction through the port 8 in the tubular body 1 inducing the flow of liquids from the container 25 through the tubular body 1 through the port 8 and into the mouth of a user 30. While in use, the lip stabilizer section 7 provides a stabilizing effect to the lips of a user 30 while not penetrating the lips of a user 30, and while minimizing creasing or folding of the lips of the user 30 while in use.

The invention claimed is:

1. An apparatus for drinking comprising:

a. a tubular body having a closed top end, an open bottom end located in the bottom-most surface of the tubular body, a lower straight portion, a middle curved portion, and an upper straight portion, wherein the central axis of the tubular body is entirely located in the same plane, wherein the lower straight portion is longer than the combined middle curved portion and upper straight portion, and extends from the open bottom end to the bottom of the middle curved portion, the middle curved portion is directly connected to the lower straight portion and extends from the top of the lower straight portion to the bottom of the upper straight portion, the upper straight portion is directly connected to the middle curved portion and extends from the top of the middle curved portion to the closed top end;

b. a straight elongated tubular lip stabilizer section formed on the exterior wall of the tubular body located in the upper straight portion of the tubular body between the top of the middle curved portion and the closed top end wherein the straight elongated tubular lip stabilizer section is a longitudinal length to provide a stabilizing effect to a segment of the lips of a user while not penetrating the lips of a user when in use;

c. a plurality of contiguous arc-shaped bends located in the middle curved portion comprising a first arc-shaped bend extending upward from the bottom of the middle curved portion in one direction, a second contiguous arc-shaped bend directly connected to the first arc-shaped bend extending upward from the top of the first arc-shaped bend in an opposite direction of the first arc-shaped bend extending to and directly connected to the upper straight portion, wherein the straight elongated tubular lip stabilizer section is configured perpendicular to the lower straight portion; and d. a port formed in the wall of the tubular body and located in the top surface of the tubular body and located in the center of the straight elongated tubular lip stabilizer section enabling the user to induce suction to the tubular body through the port when the lip stabilizer section is engaged by the lips of a user.

2. The apparatus for drinking of claim 1 wherein the tubular body comprises a material from the group of either: plastic, silicone, rubber, metal or glass.

3. The apparatus for drinking of claim 1 wherein the closed top end comprises a removable plug.

4. The apparatus for drinking of claim 1 wherein the lip stabilizer section comprises a raised pad for engaging the lips of a user when in use.

5. The apparatus for drinking of claim 1 wherein the straight elongated tubular lip stabilizer section is configured at or near horizontal such that the straight elongated tubular lip stabilizer is at or near parallel to the lips of a user when in use.

6. The apparatus for drinking of claim 1 wherein the straight elongated tubular lip stabilizer section provides a stabilizing effect to the lips of a user when the straight elongated tubular lip stabilizer section comes in contact with the lips of a user when in use.

7. A method for using the apparatus for drinking of claim 1 comprising:

a. inserting the lower portion of the tubular body into a container containing liquids;

b. engaging the lip stabilizer section whereby the lip stabilizer section comes in contact with the lips of a user at or near parallel with the lips of a user while not penetrating the lips of a user;

c. inducing suction, by a user, to the port located in the lip stabilizer section; and d. enabling the flow of liquids through the port of the lip stabilizer section into the mouth of a user while providing a stabilizing effect to the lips of a user.

8. The apparatus for drinking of claim 1 wherein the middle curved portion is removably connected to the lower straight portion.

* * * * *